US006868562B2

(12) United States Patent
Arp et al.

(10) Patent No.: US 6,868,562 B2
(45) Date of Patent: Mar. 22, 2005

(54) SKIMMER PROTECTOR WITH INTREGRAL BLOW TUBE

(75) Inventors: George F. Arp, Stuart, FL (US); Andrew Arp, 15 Lafayette St., Burlington, VT (US) 05401

(73) Assignee: Andrew Arp, Burlington, VT (US)

( * ) Notice: Subject to any disclaimer, the term of this patent is extended or adjusted under 35 U.S.C. 154(b) by 0 days.

(21) Appl. No.: 10/390,126

(22) Filed: Mar. 17, 2003

(65) Prior Publication Data

US 2003/0213058 A1 Nov. 20, 2003

Related U.S. Application Data

(63) Continuation-in-part of application No. 10/038,993, filed on Jan. 2, 2002, now abandoned.
(60) Provisional application No. 60/259,652, filed on Jan. 4, 2001.

(51) Int. Cl.[7] ..... E04H 4/14; B29C 65/00
(52) U.S. Cl. ..... 4/496; 264/248; 264/249
(58) Field of Search ..... 4/496, 504, 512; 210/169; 264/248, 249

(56) References Cited

U.S. PATENT DOCUMENTS

| | | | | |
|---|---|---|---|---|
| 551,079 A | * | 12/1895 | Force et al. | 264/249 |
| 3,306,448 A | | 2/1967 | Baker | 210/169 X |
| 3,316,934 A | | 5/1967 | Sowers | 210/169 X |
| 3,443,264 A | | 5/1969 | Miller | 210/169 X |
| 3,552,267 A | | 1/1971 | Bushnell | 91/168 |
| 3,552,567 A | | 1/1971 | Arp | 210/169 |
| 4,345,956 A | * | 8/1982 | Cox et al. | 264/249 X |
| 4,752,979 A | | 6/1988 | Goacher, Sr. | 4/496 |
| 5,060,321 A | | 10/1991 | Breneisen | 4/496 |
| 5,706,530 A | | 1/1998 | Mariano | 4/496 |
| 5,799,343 A | | 9/1998 | Semco et al. | 4/504 |
| 2003/0139760 A1 | * | 7/2003 | Stamberg | 264/248 X |

* cited by examiner

*Primary Examiner*—Robert M. Fetsuga
*Assistant Examiner*—Nicole P. Smith
(74) *Attorney, Agent, or Firm*—Brown & Michaels, PC; Eugene Stephens & Associates

(57) ABSTRACT

A skimmer protector having an integral blow tube is formed from two parts. First, a hollow, blow-molded body of resilient thermoplastic resin material having a cylindrical projection on one end with external screw threads for threading into the intake pipe of a swimming pool skimmer. Second, an open integral tube running from and through said screw threaded portion to an opening elsewhere on its blow-molded body. The cylindrical projection on the body of the device is intended and designed to be threaded into the intake pipe or other part of a pool skimmer. When connected thereto, the skimmer protector is positioned to absorb/buffer the forces exerted by the expansion of ice as it freezes within the walled regions of the skimmer. Welding the aforesaid integral tube to the body serves to create a hermetically sealed air space between the tube and the outer walls of the body. This hermetically sealed air space helps to resiliently stiffen the body of the skimmer protector. This in turn allows it to better perform its function in absorbing ice expansion pressure, particularly repeated compression due to the repeated freezing and thawing of ice in the skimmer during a typical winter season. In addition, the sealed integral tube can be used as a blowout tube to assist in the removal of water from the piping connected to the skimmer.

30 Claims, 4 Drawing Sheets

SKIMMER PROTECTOR WITH INTREGRAL BLOW TUBE

RELATED APPLICATIONS

This application is a Continuation-in-part of abandoned U.S. application Ser. No. 10/038,993, filed 2 Jan. 2002, which parent application claims the benefit of U.S. Provisional Application No. 60/259,652, filed on 4 Jan. 2001, the disclosure of the prior applications being hereby incorporated by reference.

TECHNICAL FIELD

Our invention pertains to the general field of devices intended for the protection of swimming pools from freeze damage. More particularly, it deals with a skimmer protector for placement in the skimmer of a swimming pool.

BACKGROUND

Winter freeze-up of swimming pools causes considerable damage from ice expansion, particularly in the region of the skimmer for the pool. A prior invention of a skimmer protector (U.S. Pat. No. 3,552,267) of one of the co-inventors of this application recognized the special need for protection within the skimmer area and provided a simple, effective, and economical means for absorbing the expansion of ice in the skimmer to prevent damage to the skimmer. In the past, the protection provided by this invention has been supplemented by the use of blow-out tubes to force compressed air through skimmer piping in order to remove all water that might freeze in the winter and crack the piping. However, there has heretofore been no practical device that provided both features.

SUMMARY OF THE INVENTION

Our invention is based on a hollow, blow-molded body of resilient thermoplastic resin material having a cylindrical projection on one end with external screw threads for threading into the intake pipe of a swimming pool skimmer. Cylindrical protrusions are provided around two openings on the body, allowing the body to be welded at each end to an extruded thermoplastic tube nested in the protrusions and running through the body. The final product is a skimmer protector with an open integral tube running from and through its screw-threaded portion to an opening elsewhere on its blow-molded body. The cylindrical projection on the body of the device is intended and designed to be threaded into the intake pipe or other part of a pool skimmer. When connected thereto, our invention is positioned to act as a skimmer protector and absorb/buffer the forces exerted by the expansion of ice as it freezes within the walled regions of the skimmer. Its function in this role is improved by the inclusion of the aforesaid integral tube, which (by virtue of its welding to the body) serves to create a hermetically sealed air space between the tube and the outer walls of our skimmer protector. This air space, as described in more detail in the next paragraph helps to resiliently stiffen the body of our invention, allowing it to better perform its function in absorbing ice expansion pressure during repeated melt/thaw cycles. In addition, this integral tube can be used as a blowout tube to assist in the removal of water from the piping connected to the skimmer.

The manner in which the hermetically sealed air space of our invention helps to resiliently stiffen its body during repeated melt/thaw cycles can best be understood by analogizing its body to a plastic beverage container. Such a container, if uncapped, will resist crushing and maintain its resiliency to a certain degree. However, its resistance is very limited and it will not rebound to its original shape after being crushed. Similarly, if our skimmer protector body did not have a hermetically sealed air space, it could resist ice pressure to some degree, but if crushed, it would not rebound during the next thaw. Whether as the result of an initial event or of a series of freezes, it would eventually be completely crushed and unable to provide any protection against ice pressure to the skimmer. Likewise, an imperfect seal will, in such an environment, prove ineffective in the long range. Successive freeze cycles (by compressing the air contained in the skimmer protector) will eventually drive out all of the air that protects it and keeps it from being rendered ineffective by successive freeze events. That is why our hermetically sealed air space is so important to the function of our invention and so revolutionary in our industry.

DRAWINGS

Figure 3A:
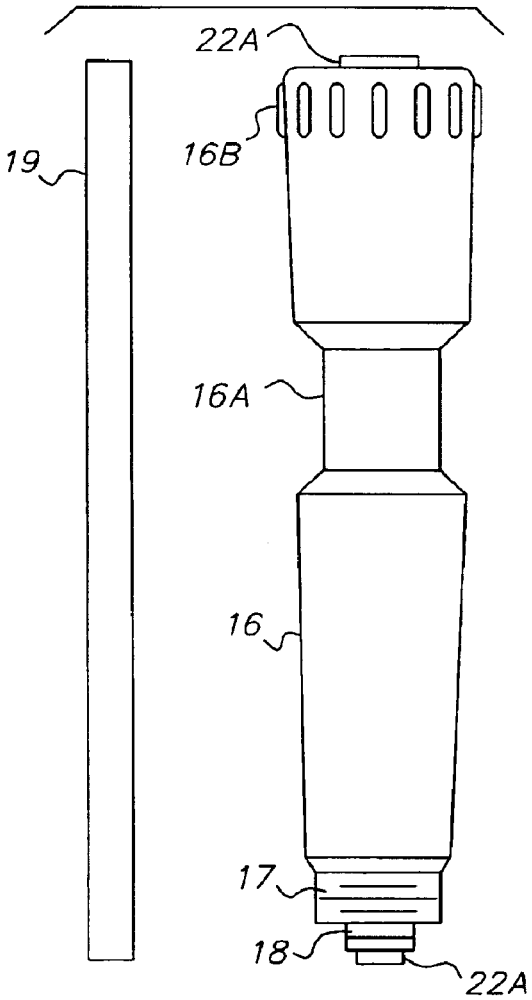
FIG. 3A illustrates the two basic parts from which our skimmer protector is formed.
Figure 3B:
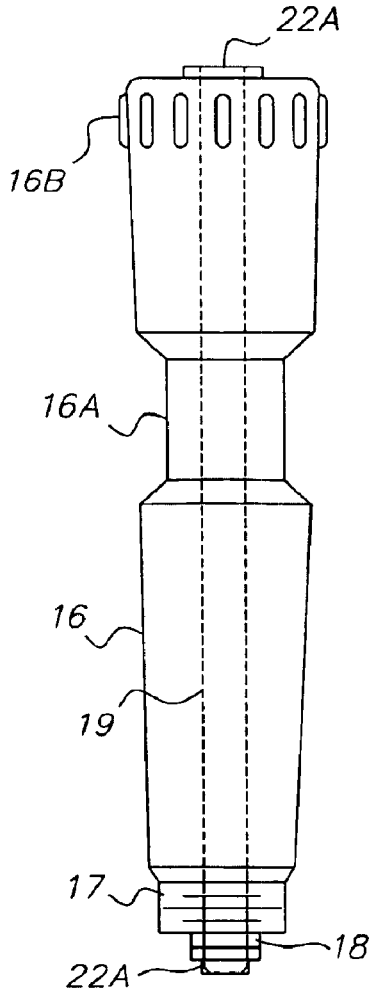
FIG. 3B illustrates the two basic parts of our skimmer protector when placed together with the tube of our invention inserted into the interior of its hollow body.
Figure 3C:
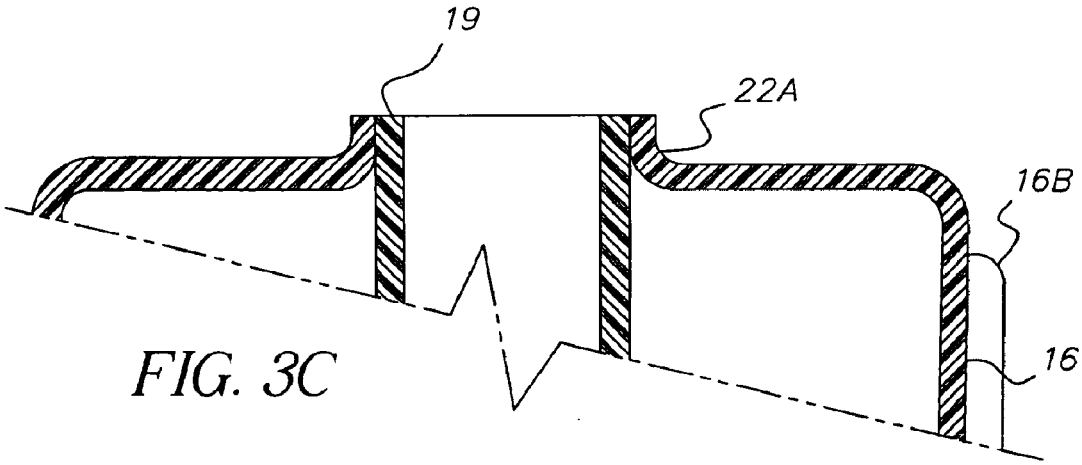

FIG. 3C provides a detail view illustrating the nesting of the tube of our skimmer protector within a protrusion at the top of its body.

Figure 4C:
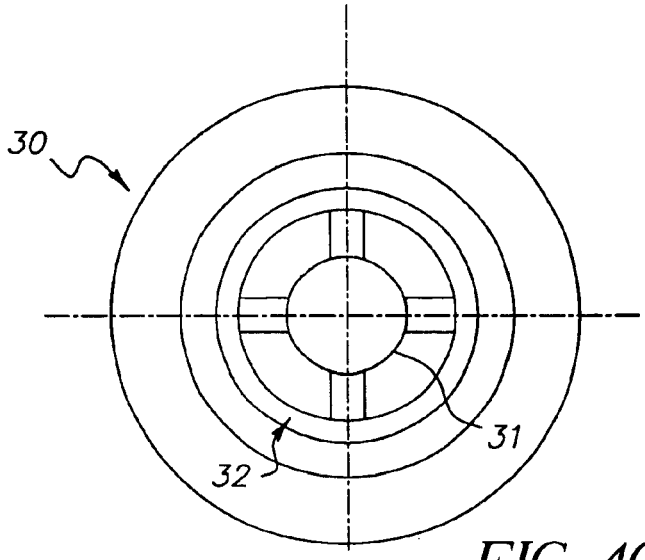
Figure 4B:
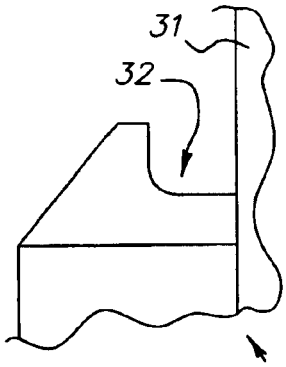
Figure 4A:
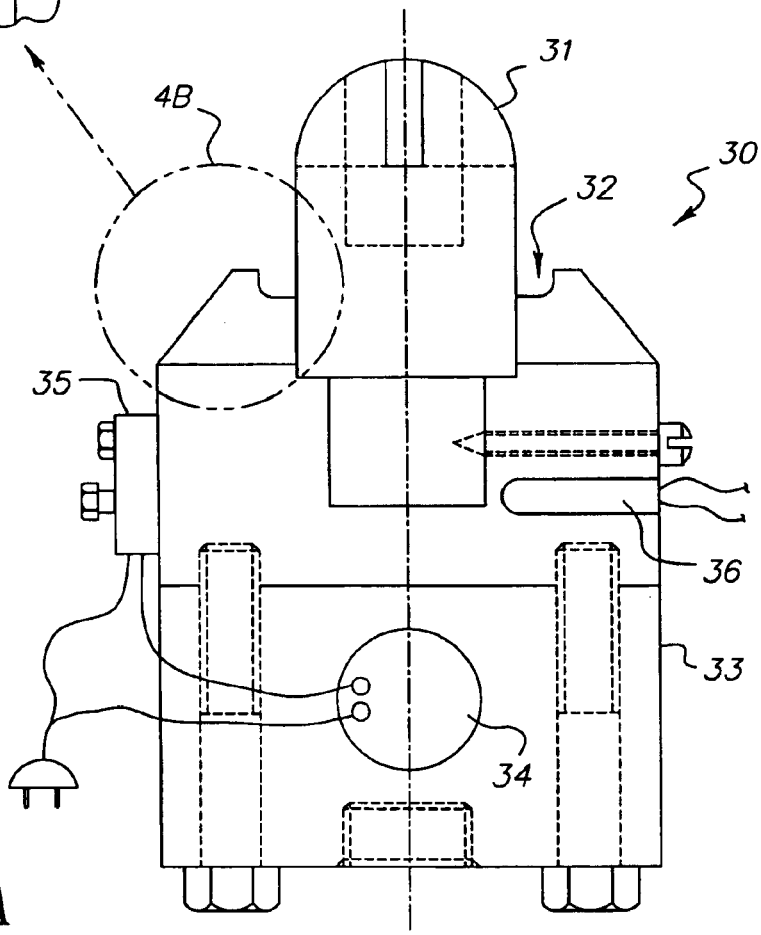

FIG. 4A provides a cross-sectional side view of the welding tool we invented and use in forming our skimmer protector.

FIG. 4B provides a more detailed cross-sectional view of the welding groove forming part of the welding tool used in forming our skimmer protector.

FIG. 4C provides a view of surfaces and features of the welding tool illustrated in FIG. 4B that engage the skimmer protector during the welding process.

DETAILED DESCRIPTION

1. Principal Features of Our Skimmer Protector

Figure 1:
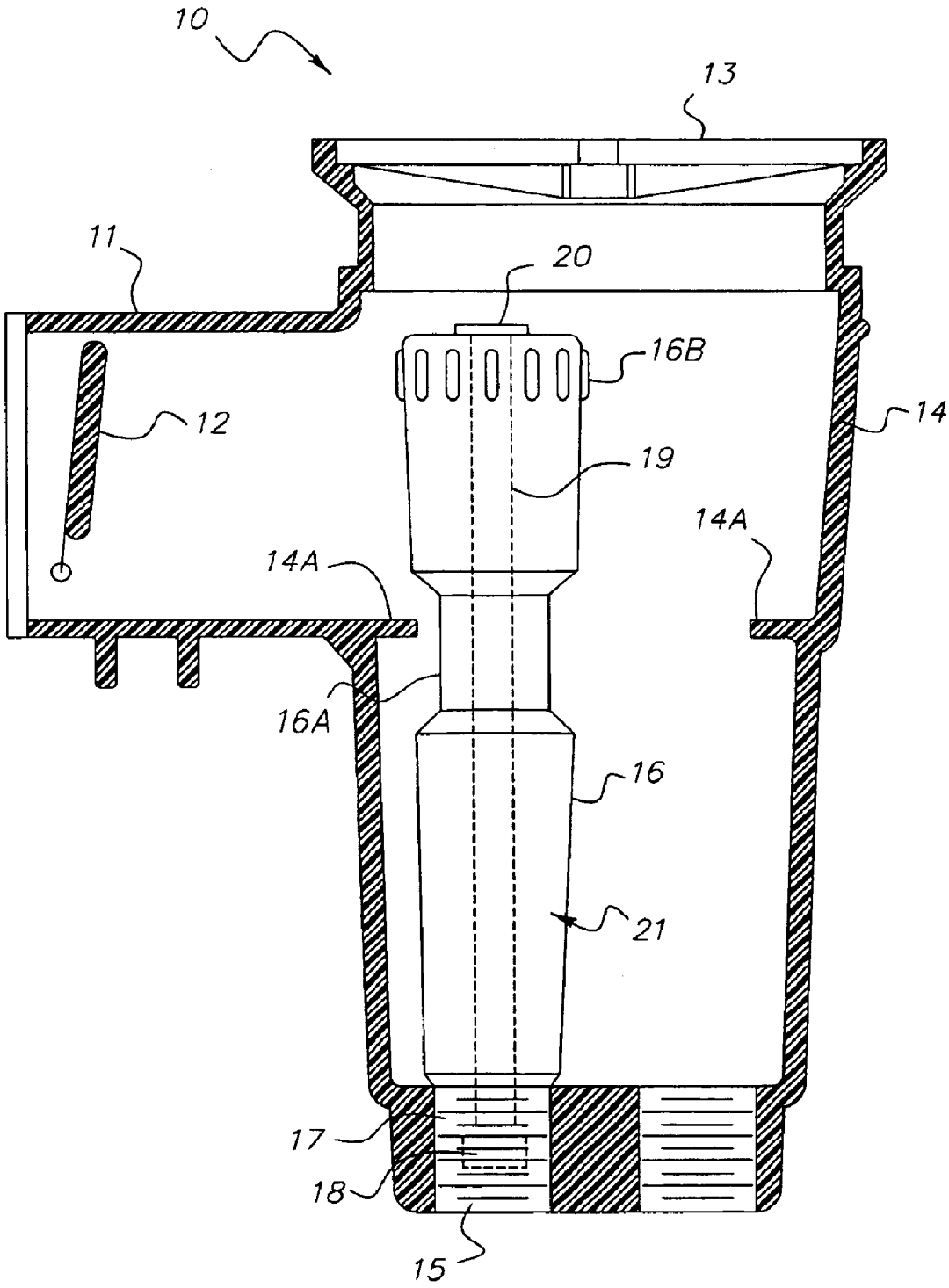
FIG. 1 shows an elevational cross-sectional view of a swimming pool skimmer with the skimmer protector of our invention installed in place.

A good overview of our invention and its use can be obtained by review of FIG. 1. As will be noted from review of this drawing figure, a swimming pool skimmer (denoted generally by arrow 10) includes an inlet passageway 11 having a weir 12 leading to a walled chamber 14. Walled chamber 14 has a cover 13 and an intake pipe 15 for drawing water from the pool to the pump and filter (not shown). Skimmer 10 can have many different shapes and sizes and can open in various ways to a pool. Also, various pipes can lead from intake pipe 15 to the pool filtration equipment.

Most of the multitude of such skimmer arrangements can be protected by our invention, which is formed from two basic parts: a hollow body 16 and a tube 19. (See, FIG. 3A). Blow-molded body 16 is hollow, substantially closed, and formed of resilient thermoplastic resin material. It is generally cylindrical or formed into cylindrical sections as illustrated and has a diameter larger than intake pipe 15 where it is adjacent to intake pipe 15. The generally cylindrical shape of body 16 is preferred for ease of blow molding, but body 16 can have other shapes if desired. In the preferred embodiment illustrated, a narrowed portion 16A of body 16 is also provided so as to allow the invention to be fitted into intake pipe 15 close to the side of walled chamber 14 without interference from a skimmer basket support rim 14A. In addition, gripping means in the form of raised semi-cylindrical projections or lugs 16B are provided around the top of body 16 to afford a better finger grip for screwing body 16 into intake pipe 15.

A cylindrical projection with external threads depends from body 16 for threading into the internal threads of intake pipe 15. Most swimming pool skimmers have a 1.5 inch tapered pipe thread in intake pipe 15. Others have a 2 inch tapered pipe thread in intake pipe 15. Thus, both a larger set of upper threads 17 (with a 2 inch diameter) and a smaller set of lower threads 18 (with a 1.5 inch diameter) are provided. However, different sized thread combinations can be provided as needed with the lower set of threads always, of course, being smaller than the upper set of threads. O-rings can be used with each set of threads 17, 18 to assure a complete seal when seated in intake pipe 15.

During the molding process, additional cylindrical stand-offs or protrusions 22A are formed on the flat surfaces present at the top and bottom of body 16. The top surface of each protrusion 22A is reamed out, leaving only the walls of the protrusion 22A. As illustrated in FIGS. 3B and 3C, tube 19 (which has a greater length than body 16) is then slipped through the openings that remain from the reamed out protrusions 22A and nested snugly in protrusions 22A. As described in more detail below, each end of tube 19 is then welded to protrusions 22A with heat and pressure so as to form integral tube 19, which is adapted for use as a blow tube in clearing pipe 15. It also results in the creation of a hermetically sealed air space (denoted generally by arrow 21) between the outer surface of its body 16 and integral tube 19.

A second means of forming top and bottom protrusions 22A could be employed using a large size blow-pin during the molding process. This would create the protrusions 22A on the top surface of body 16 for welding with integral tube 19 without going through the secondary process of reaming the protrusions 22A. Additionally, the protrusion 22A on the bottom surface of body 16 could be formed during the molding process by inserting a "dummy pin" into the mold cavity just prior to the injection of air used to give the part its shape.

Figure 2:
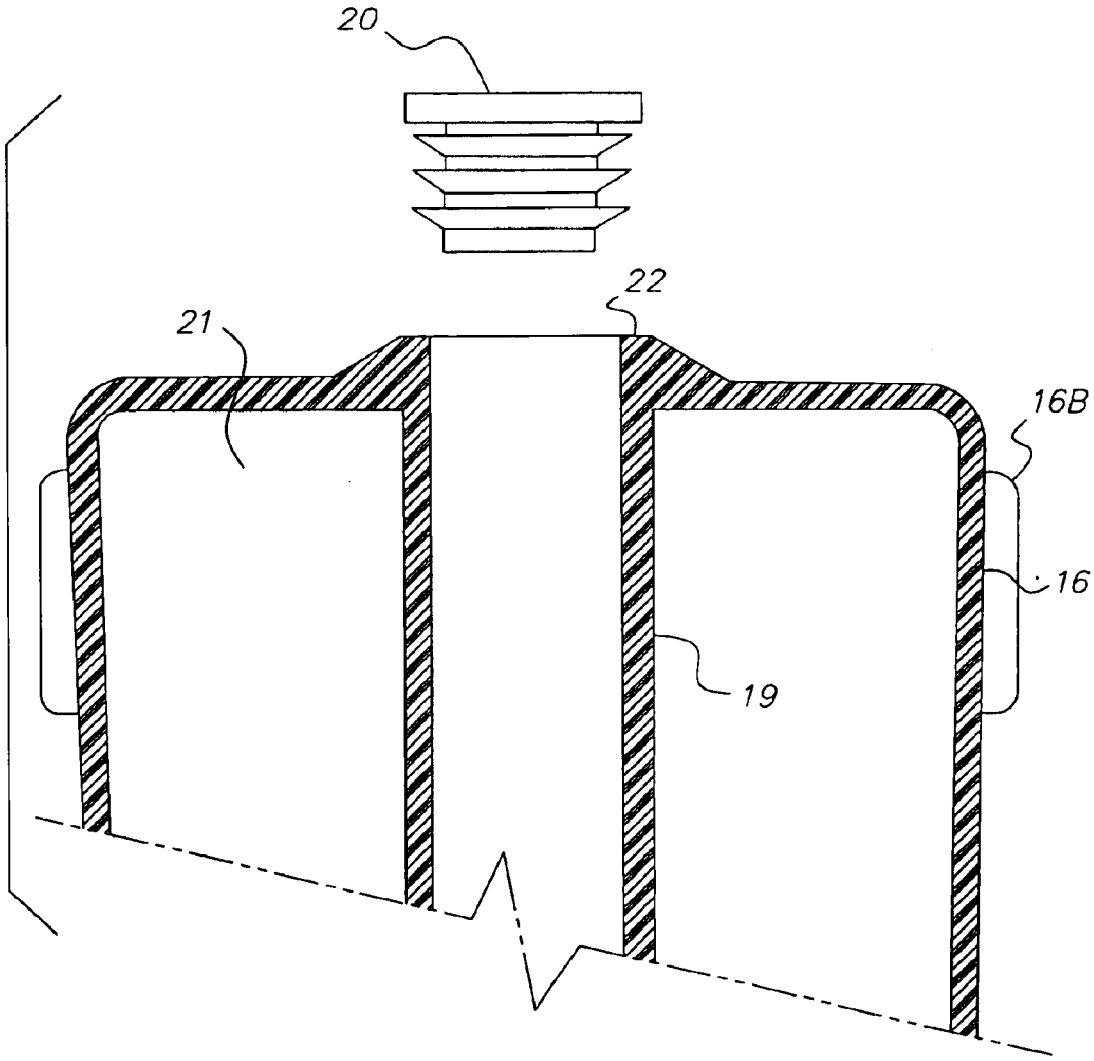
FIG. 2 shows a cross-sectional view of a portion of the top of our skimmer protector with a plug positioned for insertion therein.

The welding of protrusions 22A to abutting portions of tube 19 results in a slightly raised ring or ridge 22 of plastic on the top and bottom surfaces of body 16. As illustrated in FIG. 2, the raised ridge 22 of the top surface will accommodate a stopper such as plug 20 to prevent water from entering pipe 15 via integral tube 19 after installation. Such plugs or caps can be held in place frictionally by the use of screw threading, by snap rings, or by other means and can be provided for either or both ends of tube 19.

We have discovered that the width of integral tube 19 should, ideally, be approximately ¾ inches. It is desirable to make tube 19 as small in diameter as possible as this maximizes the volume and function of hermetically sealed air space 21 and makes tube 19 stronger and less easily crushed. However, a larger diameter for tube 19 is desirable in terms of its function as a blowout tube (as our invention is intended for use with common blowers generating a high volume low pressure air stream). Through experimentation we have determined that a diameter of approximately ¾ inches represents an ideal compromise that satisfies both requirements.

2. Construction of Our Skimmer Protector

The welding of body 16 to integral tube 19 is done using a specialized welding tool 30 and relies on the above-described structure of protrusions 22A and tube 19. As illustrated in FIGS. 4A through 4C, the welding tool 30 of our invention has a cylindrical mandrel 31 that is surrounded by a concentric welding groove 32. Both mandrel 31 and welding grove 32 should be coated with a non-stick material such as Teflon to assure the molded plastic does not adhere during the welding process. Mandrel 31 centers welding groove 32 and prevents tube 19 from collapsing or distorting during welding. It is made of a non-conductive material that allows it to be used as a centering device and partially as a swage block allowing the welding process to occur primarily on the exterior of the part. (Four cored out slots at 90 degrees to each other help to dissipate heat.) Mandrel 31 is inserted into the open center of a protrusion 22A until welding groove 32 surrounds and presses against the end of the protrusion 22A and the end of the tube 19 nested therein. Welding groove 32 captures both the wall of the protrusion 22A and the wall of the integral tube 19. The two walls of plastic are joined by simultaneously melting and compressing them to form sealed raised, circular rim 22 on the flat surfaces at both the top and bottom of the part.

In order for the above-described welding process to reach a proper result, certain factors are necessary. First, it is desirable for the walls of tube 19 and the walls of protrusion 22A to melt simultaneously and to the same approximate degree. Using the same thermoplastic material with the same approximate thickness for both facilitates this. Alternatively, if different materials are used, they should be substantially identical in terms of their melt index and specific gravity. In addition, heat must be applied to the ends of protrusions 22A and tube 19. This is the only location where heat can be applied directly to the interface between these two parts and is the primary reason for the provision of protrusion 22A on body 16. Second, the volume and shape of welding groove 32 must be calibrated and shaped so as to accommodate the melt generated from the abutting ends of tube 19 and protrusion 22A and to mold this melt into an appropriate and desirable raised rim 22.

Welding tool 30 is connected to a heater block 33. Both can be made of a durable material such as brass or aluminum with sufficient density, weight, length and diameter to maintain the desired heat applied. Tool 30 can be machined out of square bar stock or round rod. It is formed with an outer (major) diameter large enough to accommodate welding groove 32, a center stepped hole for insertion of mandrel 31, and a mounting device to attach it to heater block 33.

Heater block 33 can be of the same diameter or larger than tool and is attached to the lower end of the tool opposite mandrel 31. As illustrated, it can advantageously be provided with holes to accept mounting screws to fit it to tool 30. The other end of heater block 33 can be provided with a threaded hole as illustrated for mounting to an arbor press or pneumatic cylinder. It can be surrounded by an electric heater band, or drilled out for a cartridge type heater 34. The heat-controlling device can be a surface mounted bimetallic thermostat 35, or a thermocouple 36 mounted at or on tool 30. The thermocouple is advantageously used in conjunction with an adjustable digital or analog read out.

3. Use of Our Skimmer Protector

To install our invention, it is merely necessary to remove cover 13 and screw body 16 into pipe 15 via the appropriately sized screw threads provided. With body 16 threaded in place, intake pipe 15 is protected from ice and debris and body 16 extends above intake pipe 15 into the walled regions of skimmer 10 where it can be compressed by expanding ice to protect walls 14 from ice pressure. (The resilient materials forming body 16 and integral tube 19, as well as the air contained in hermetically sealed air space 21, are readily compressed by expanding ice.) In addition, integral tube 19 is installed and ready to be used in clearing pipe 15 of any water that might freeze and cause damage. The flat upper surface of body 16 can accommodate air pressure devices or blower hoses of many different sizes. These are pressed against the top surface of body 16 in order to blow air through integral tube 19. Following this procedure, a plug 20 can be inserted to cap off the top of integral tube 19. After the ice season, body 16 is unscrewed and removed to ready the pool for use.

Persons wishing to practice the invention should remember that other embodiments and variations could be adapted to particular circumstances. Even though one point of view is necessarily chosen in describing and defining the invention, this should not inhibit broader or related embodiments going beyond the semantic orientation of this application but falling within the spirit of the invention. For example, many sizes and configurations of our invention can be used within the spirit of the invention. Moreover, the welds typical of our invention can also be produced using spin welding and ultrasonic welding.

We claim:

1. A skimmer protector for use in a swimming pool having a skimmer including a walled region and an intake pipe, comprising:

a. a hollow, substantially closed body having walls formed from a resilient thermoplastic material with a bottom of said body having a screw threaded cylindrical projection that can be threaded into an intake pipe, a cylindrical protrusion extending below the cylindrical projection, and a cylindrical protrusion surrounding an outer opening on said body;

b. a hollow blow-out tube having walls formed from a resilient thermoplastic material nested in said cylindrical protrusions and sealed to said protrusions such that it is in communication with said intake pipe and extends from said intake pipe through said cylindrical projection to the outer opening on the body; and c. said body with blowout tube, when threaded into an intake pipe, extending from said intake pipe so as to be compressibly disposed within a walled region of a swimming pool skimmer.

2. A skimmer protector as described in claim 1, wherein the walls of said tube and the walls of said protrusions have a substantially identical melt index.

3. A skimmer protector as described in claim 2, wherein the walls of said tube and the walls of said protrusions have a substantially identical specific gravity.

4. A skimmer protector as described in claim 1, wherein the walls of said tube and the walls of said protrusions are substantially identical in thickness.

5. A skimmer protector as described in claim 4, wherein the walls of said tube and the walls of said protrusions are formed from the same thermoplastic material.

6. A skimmer protector as described in claim 1, wherein ends of said blow-out tube abutting said cylindrical protrusions are welded to said cylindrical protrusions to form a hermetically sealed air space between the blow-out tube and the body.

7. A skimmer protector as described in claim 6, wherein the ends of said blowout tube abutting said cylindrical protrusions are sealed to said cylindrical protrusions by heat welding abutting portions of the cylindrical protrusions and the blowout tube.

8. A skimmer protector as described in claim 1 wherein the outer opening is located at an end of the body opposite the cylindrical projection.

9. A skimmer protector as described in claim 8 wherein said body is generally cylindrical in shape.

10. A skimmer protector as described in claim 9 wherein said body has a larger diameter than said intake pipe.

11. A skimmer protector as described in claim 10 wherein a portion of said body arranged to confront a skimmer basket support rim is narrower in diametrical relationship to said cylindrical projection than a portion of said body adjacent to said cylindrical projection.

12. A skimmer protector as described in claim 11 wherein the end of said body opposite the cylindrical projection has gripping means to afford a finger grip for screwing said body into said intake pipe.

13. A skimmer protector as described in claim 12 further comprising a removable cap for plugging an end of said hollow blowout tube.

14. A skimmer protector as described in claim 13 wherein said screw threaded cylindrical projection has portions with different diameters, thereby enabling the device to be screwed into intake pipes having such different diameters.

15. A skimmer protector as described in claim 1 wherein a raised rim surrounds the outer opening, the raised rim being formed by heat welding and compressing abutting portions of the cylindrical protrusions and the blow-out tube within a molding groove.

16. A method for producing a skimmer protector for use in a swimming pool having a skimmer including a walled region and an intake pipe, comprising:

providing a hollow body with walls formed from resilient thermoplastic material, the body having a top and a bottom with the bottom having a screw threaded cylindrical projection that can be threaded into said intake pipe, an open cylindrical protrusion extending below the cylindrical projection, and an open cylindrical protrusion extending above the top;

providing a hollow blowout tube with walls formed from resilient thermoplastic material;

nesting said blow-out tube within said open cylindrical protrusions in such manner that it extends through said body from said cylindrical projection at the bottom to an outer opening at the top; and sealing ends of said blowout tube abutting said cylindrical protrusions to said cylindrical protrusions.

17. A method for producing a skimmer protector as described in claim 16, wherein the walls of said tube and the walls of said body, have a substantially identical melt index.

18. A method for producing a skimmer protector as described in claim 17, wherein the walls of said tube and the walls of said body, have a substantially identical specific gravity.

19. A method for producing a skimmer protector as described in claim 16, wherein the walls of said tube and the walls of said body, arc substantially identical in thickness.

20. A method for producing a skimmer protector as described in claim 16, wherein the walls of said tube and the walls of said body, are formed from the same thermoplastic material.

21. A method for producing a skimmer protector as described in claim 16, wherein welding ends of said blowout tube abutting said cylindrical protrusions to said cylindrical protrusions forms a hermetically sealed air space between the blow-out tube and the body.

22. A method for producing a skimmer protector as described in claim 16, wherein the ends of said blow-out tube abutting said cylindrical protrusions are welded to said cylindrical protrusions by heat welding abutting portions of the cylindrical protrusions and the blow-out tube.

23. A method for producing a skimmer protector as described in claim 16, wherein the ends of said blow-out tube abutting said cylindrical protrusions are welded to said cylindrical protrusions by heat welding and compressing abutting portions of the cylindrical protrusions and the blow-out tube within a welding groove.

24. A method for producing a skimmer protector as described in claim 23, wherein heat and pressure is applied by a tool having a central mandrel suitable for snug disposition within the blow-tube to prevent distortion thereof while heat and pressure is being applied.

25. A method for producing a skimmer protector as described in claim 23, wherein the volume and shape of said welding groove is selected to accommodate melt from the abutting ends of the blow-out tube and the protrusions and to shape this melt into a raised rim.

26. A method for producing a skimmer protector for use in a swimming pool having a skimmer including a walled region and an intake pipe, comprising:

providing a hollow body with walls formed from resilient thermoplastic material, the body having a top and a bottom with the bottom having a screw threaded cylindrical projection that can be threaded into said intake pipe, an open cylindrical protrusion extending below the cylindrical projection, and an open cylindrical protrusion extending above the top;

providing a hollow blowout tube with walls formed from resilient thermoplastic material;

nesting said blowout tube within said cylindrical protrusions in such manner that it extends through said body from said cylindrical projection at the bottom to an outer opening at the top;

inserting a mandrel into the blow-tube to prevent distortion thereof while heat and pressure is being applied abutting portions of the cylindrical protrusions and the blow-out tube; and heat welding and compressing abutting portions of the cylindrical protrusions and the blowout tube within a welding groove adjacent and surrounding said mandrel so as to join said blow-out tube to said body and to form a hermetically sealed air space between the blow-out tube and the body.

27. A method for producing a skimmer protector as described in claim 26, wherein the walls of said tube and the walls of said body have a substantially identical melt index and specific gravity.

28. A method for producing a skimmer protector as described in claim 27, wherein the walls of said tube and the walls of said body are substantially identical in thickness.

29. A method for producing a skimmer protector as described in claim 28, wherein the walls of said tube and the walls of said body are formed from the same thermoplastic material.

30. A method for producing a skimmer protector as described in claim 29, wherein the volume and shape of said welding groove is selected to accommodate melt from the abutting ends of the blow-out tube and the protrusions and to shape this melt into a raised rim.

* * * * *